United States Patent [19]

Wochnowski

[11] Patent Number: 5,063,943

[45] Date of Patent: Nov. 12, 1991

[54] METHOD OF AND APPARATUS FOR MONITORING THE QUALITY OF A TOBACCO STREAM

[75] Inventor: Waldemar Wochnowski, Hamburg-Meiendorf, Fed. Rep. of Germany

[73] Assignee: Korber AG, Hamburg, Fed. Rep. of Germany

[21] Appl. No.: 525,081

[22] Filed: May 17, 1990

[30] Foreign Application Priority Data

May 20, 1989 [DE] Fed. Rep. of Germany ..... 3916486

[51] Int. Cl.[5] ..... A24C 5/32

[52] U.S. Cl. ..... 131/84.4; 131/906; 131/908

[58] Field of Search ..... 131/84.4, 906, 908

[56] References Cited

U.S. PATENT DOCUMENTS 3,030,966 4/1962 Lanore ..... 131/84
4,172,515 10/1979 Wochnowski .
4,185,644 1/1980 Heitmann et al. .
4,190,061 2/1980 Heitmann et al. .
4,373,538 2/1983 Steiniger ..... 131/109 R
4,556,071 12/1985 Hoffmann ..... 131/906
4,616,662 10/1986 Hartmann et al. ..... 131/906
4,865,052 9/1989 Hartmann et al. ..... 131/908
4,875,494 10/1989 Siems ..... 131/84.4

*Primary Examiner*—V. Millin
*Assistant Examiner*—Lynne A. Reichard
*Attorney, Agent, or Firm*—Peter K. Kontler

[57] ABSTRACT

The ratio of different types of tobacco in a tobacco stream which is conveyed past a trimming device is monitored by monitoring the distance of the trimming plan from the conveyor for the stream while the mass flow of the stream is maintained at a constant value. Variations of the distance of the trimming plane from the conveyor are indicative of variations of the ratio of different tobaccos in the stream, and such variations are further indicative of fluctuations of filling power of tobacco which forms the stream.

27 Claims, 1 Drawing Sheet

METHOD OF AND APPARATUS FOR MONITORING THE QUALITY OF A TOBACCO STREAMcl BACKGROUND OF THE INVENTION

The invention relates to improvements in methods of and in apparatus for monitoring the quality of tobacco streams, and more particularly to improvements in methods of and in apparatus for monitoring the quality of tobacco streams which constitute blends of several tobaccos, such as Virginia, Burley and Oriental tobacco.

It is customary to form a tobacco stream on a conveyor which forms part of a cigarette rod making or an analogous machine and serves to transport the stream past a trimming or equalizing device so that the thus trimmed stream is ready for draping into a web of cigarette paper or other suitable wrapping material. As a rule, the trimming or equalizing action is dependent upon measurements of density (i.e., mass flow) of the tobacco stream on the conveyor. Thus, the trimming action is regulated in such a way that the density of the equalized stream is at least substantially constant. This ensures that the density of each discrete rod-shaped article (such as a cigarette) which is obtained as a result of subdivision of the draped stream into sections of unit length or multiple unit length matches or closely approximates an optimum value.

Tobacco which forms a stream of tobacco shreds and/or other particles on the conveyor is normally a mixture or blend of two or more different tobaccos, particularly Virginia, Burley and Oriental tobacco. Certain blends further contain relatively small percentages of other types of tobacco. At least the main ingredients of the stream are processed independently of each other to be intermixed immediately or shortly prior to the cutting step. An important prerequisite for satisfactory quality of smokers' products is the constancy of mixture of tobaccos which constitute a particular blend because this determines the taste of a brand of cigarettes or other smokers' products.

OBJECTS OF THE INVENTION

An object of the invention is to provide a novel and improved method of monitoring and preserving the quality of a tobacco stream in a cigarette rod making or like machine.

Another object of the invention is to provide a method of automatically monitoring and regulating the quality of a moving stream which contains two or more different types of tobacco.

A further object of the invention is to provide a method which renders it possible to ensure that each and every unit length of a continuous tobacco stream contains the same blend of two or more different tobaccos.

An additional object of the invention is to provide a method which renders it possible to ascertain and regulate the quality of a tobacco stream while the stream undergoes treatment which is necessary to convert it into the filler of a cigarette rod or the like.

Still another object of the invention is to provide a method which enables the person or persons in charge to visually monitor the quality of a mixture of two or more different types of tobacco in a cigarette rod making machine.

A further object of the invention is to provide a novel and improved apparatus for the practice of the above outlined method.

Another object of the invention is to provide a rod making machine which embodies an apparatus for the practice of the above outlined method.

SUMMARY OF THE INVENTION

One feature of the present invention resides in the provision of a method of monitoring the quality of a stream which is a blend of several tobaccos, which is transported by a conveyor and which contains a surplus of tobacco. The method comprises the steps of maintaining the mass flow on the conveyor at an at least substantially constant value, removing the surplus from the stream on the conveyor, and monitoring the ratio of several tobaccos in the blend.

The removing step includes equalizing the stream in a plane which is located at a variable distance from the conveyor, depending upon the quantity of surplus in the stream on the conveyor, and the monitoring step includes ascertaining the distance of the plane from the conveyor because such distance is indicative of the ratio of tobaccos in the blend.

The method can further comprise the step of ascertaining the changes of the distance of the plane from the conveyor within a predetermined period of time and/or the extent of standard deviations of the distance from an average value. The method can also comprise the steps of generating signals denoting the distance of the plane from the conveyor and displaying such signals.

The method can further comprise the steps of generating first signals which denote the monitored ratio of several tobaccos in the blend, monitoring the temperature and/or the moisture content of tobacco in the stream, generating second signals denoting the monitored temperature and/or the monitored moisture content, and correcting the first signals in dependency upon the characteristics of the second signals in order to eliminate the influence of temperature and/or moisture content of the stream upon the accuracy with which the first signals denote the ratio of tobaccos in the blend.

Another feature of the invention resides in the provision of a method of monitoring the quality of a stream which is a blend of several tobaccos, which is transported by a conveyor and which contains a surplus of tobacco. The method comprises the steps of removing the surplus from the stream on the conveyor including equalizing or trimming the stream in a plane which is located at a variable distance from the conveyor (depending upon the quantity of surplus in the stream on the conveyor), and monitoring the filling power of tobacco in the stream including monitoring the distance of the plane from the conveyor.

The method can further comprise the step of maintaining the mass flow of tobacco in the stream at an at least substantially constant value, the step of ascertaining changes of the distance of the plane from the conveyor within a predetermined period of time and/or the step of ascertaining the extent of standard deviations of such distance from an average value.

The method can further comprise the steps of generating first signals which denote the monitored filling power, monitoring the temperature and/or the moisture content of tobacco in the stream, generating second signals which denote the monitored temperature and/or the monitored moisture content, and correcting the first signals in dependency upon the characteristics (e.g., intensity) of second signals in order to eliminate the influence of temperature and/or moisture content of the stream upon the accuracy with which the first signals denote the filling power of tobacco in the stream.

The method can further comprise the steps of generating signals which denote the distance of the plane from the conveyor and displaying the signals.

Still further, the method can comprise the steps of generating signals which denote the filling power of tobacco in the stream, and regulating the filling power of tobacco as a function of the intensity and/or one or more other characteristics of such signals.

A further feature of the invention resides in the provision of an apparatus for monitoring the quality of a stream which is a blend of several tobaccos and contains a surplus of tobacco. The improved apparatus comprises means for transporting the stream along a predetermined path, means for removing the surplus from the stream in a predetermined portion of the path, and means for monitoring the ratio of tobaccos in the blend. Such apparatus can further comprise means for maintaining the mass flow of tobacco on the conveyor at an at least substantially constant value.

The removing means includes means for trimming or equalizing the stream in a predetermined portion of the path and for varying the distance of the plane from the transporting means in dependency upon the quantity of surplus in the predetermined portion of the path. The monitoring means includes means for measuring the distance of the plane from the transporting means and/or for measuring the extent of travel of the plane relative to the transporting means. Such apparatus can further comprise means for ascertaining the extent of standard deviations of the aforementioned distance from an average value.

The means for measuring the distance of the plane from the transporting means can include means for generating signals which denote the measured distance (i.e., the monitored ratio of tobaccos in the blend), and the apparatus can further comprise means for displaying such signals.

Still another feature of the invention resides in the provision of an apparatus for monitoring the quality of a stream which is a blend of several tobaccos and contains a surplus of tobacco. The apparatus comprises means for transporting the stream along a predetermined path, means for removing the surplus from the stream in a predetermined portion of the path including means for trimming or equalizing the stream in a predetermined plane and for varying the distance of the plane from the transporting means in dependency upon the quantity of surplus in the predetermined portion of the path, and means for monitoring the filling power of tobacco in the stream including means for ascertaining the distance of the plane from the transporting means.

The apparatus can further comprise means for maintaining the mass flow of tobacco on the transporting means at an at least substantially constant value and/or means for ascertaining the extent of standard deviations of the aforementioned distance from an average value.

The ascertaining means can include means for measuring the extent of travel of the plane relative to the transporting means.

The monitoring means can further include means for generating signals which denote the distance of the plane from the transporting means, and such apparatus can further comprise means for displaying the signals. Still further, signals which denote the aforementioned distances (and hence the filling power of tobacco on the transporting means) can be used to influence the operation of a means for regulating the filling power of tobacco, i.e., the filling power can be regulated as a function of the intensity and/or other characteristics of signals which denote the distance of the trimming or equalizing plane from the transporting means.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
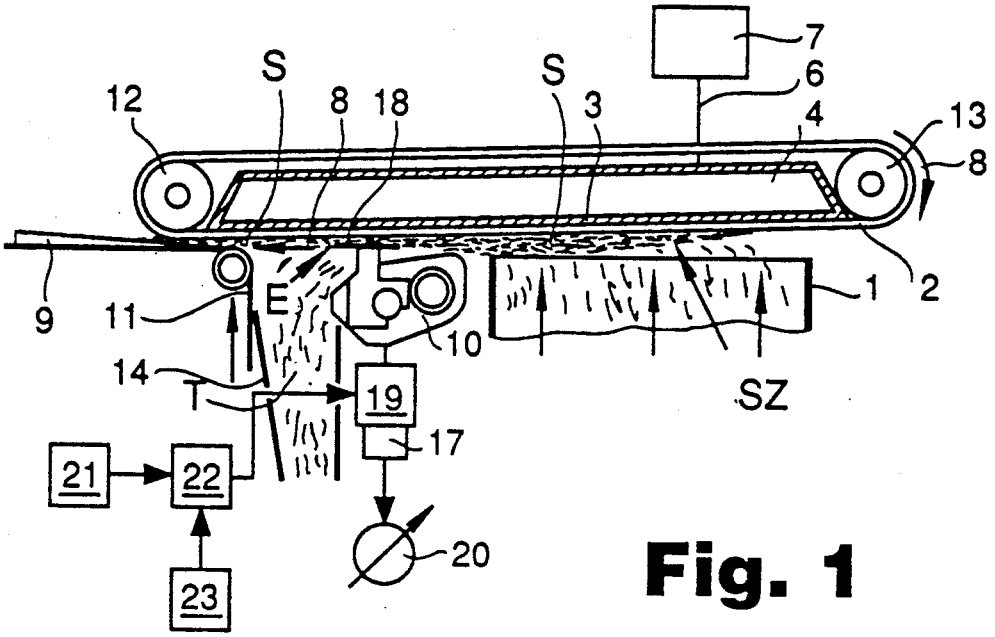
FIG. 1 is a partly elevational and partly longitudinal vertical sectional view of an apparatus which is installed in a cigarette rod making machine and is designed to furnish signals denoting deviations of the ratio of different tobaccos in a tobacco stream from a desired ratio.

FIG. 1 shows a portion of a cigarette rod making machine including an apparatus which embodies one form of the invention. The machine can be of the type known as VE 80 which is produced and distributed by the assignee of the present application. FIG. 1 merely shows a stream building zone SZ which receives shredded and/or otherwise comminuted particles of tobacco leaves from a suitable distributor (also called hopper), e.g., a distributor of the type disclosed in U.S. Pat. No. 4,373,538. A duct 1 of the distributor discharges an ascending shower of tobacco particles against the underside of the lower reach of an endless foraminous belt conveyor 2 constituting a means for transporting a continuous stream S of tobacco particles along a predetermined path, namely in a direction to the left as indicated by arrows 8. The lower reach of the conveyor 2 advances beneath the perforated bottom wall 3 of a suction chamber 4 having an outlet connected with a suitable suction generating device (e.g., a fan 7) by a conduit 6. The bottom wall 3 can constitute the top wall of a tobacco channel having an inverted U-shaped cross-sectional outline. The suction chamber 4 ensures that the growing tobacco stream is attracted to the underside of the lower reach of the conveyor 2 and that the fully grown stream S advances past a trimming or equalizing station where the surplus T of tobacco particles is removed by a trimming or equalizing device 10.

The conveyor 2 is trained over pulleys 12, 13 at least one of which is driven in any suitable way (not shown) in order to advance the stream S in the direction of arrows 8. The trimmed stream is transported onto a continuous strip or web 11 of cigarette paper or other suitable wrapping material prior to entering a wrapping mechanism 9 wherein the web is draped around the trimmed stream to form therewith a continuous cigarette rod which is ready to be subdivided into cigarettes or other rod-shaped smokers' products of unit length or multiple unit length.

The trimming or equalizing device 10 can be of the type disclosed in U.S. Pat. No. 3,030,966; it can comprise two substantially coplanar discs or wheels which are disposed in a trimming or equalizing plane E, and a paddle wheel or another suitable rotary tool beneath the plane E to remove the surplus T from the main portion of the stream S. The removed surplus is returned into the distributor by way of a funnel 14 in the customary way to be admixed to particles which form the ascending shower in the duct 1. The wrapping mechanism 9 is preferably designed to effect at least some compacting of the freshly trimmed stream (called filler) while the trimmed stream is being draped into the web 11. The manner in which at least one marginal portion of the web 11 is coated with a suitable adhesive and in which the web is caused to from a seam is known and forms no part of the present invention. The same holds true for the mechanism (called cutoff) which divides the cigarette rod into sections of unit length or multiple unit length.

The trimming or equalizing device 10 further comprises a reversible motor 19 or any other suitable means for varying the distance of the plane E from the lower reach of the conveyor 2 in dependency upon the quantity of surplus T of tobacco particles in that portion of the path for the stream S which is located at the trimming station. The motor 19 receives appropriate signals from a signal comparing circuit 22 which, in turn, receives signals from a density monitoring device 21. The latter ascertains the density of successive increments of the filler in the cigarette rod or in the discrete cigarette rod sections and transmits signals which are indicative of the ascertained density. The circuit 22 can cause the motor 19 to move the trimming discs of the device 10 up or down in order to move the plane E nearer to or further away from the lower reach of the conveyor 2 and to thus determine the quantity of tobacco particles in successive increments of the equalized stream reaching the web 11 and the wrapping mechanism 9.

The reference character 23 denotes an adjustable potentiometer or another suitable source of reference signals representing the desired or optimum density of the filler in the cigarette rod. The circuit 22 compares the reference signal from the source 23 with the actual value signals from the density monitoring device 21 (i.e., with signals denoting the actual density of successive increments of the trimmed stream) and causes the motor 19 to change the level of the plane E when the monitored density deviates from the desired or optimum density.

A presently preferred density monitoring device 21 which can be used in the apparatus of FIG. 1 comprises an ionization chamber at one side of the path for the cigarette rod and a source of corpuscular radiation (e.g., a source of beta rays) at the other side of the trimmed stream opposite the ionization chamber. The latter transmits signals the intensity of which is indicative of intensity of radiation that has penetrated the filler of the cigarette rod, and such intensity is indicative of the density of successive increments of the filler in the cigarette rod.

The apparatus of FIG. 1 further comprises a position monitoring device 17 which is operatively connected with the motor 19 for the purpose of ascertaining the distance 18 of the trimming plane E from the lower reach of the conveyor 2. The position monitoring device 17 can be of the type known as F205.1G which is distributed by Novotechnik, D-7302 Ostfildern 1, Federal Republic Germany. The signal at the output of the position monitoring device 17 is indicative of the distance 18 and is transmitted to a signal displaying device 20, e.g., a gauge having a dial which is calibrated to indicate the distance 18 in millimeters or in other units of distance.

It has been found that, when the operation of the cigarette rod making machine is regulated to ensure that the density (mass flow) of the stream S is constant, the signal at the output of the position monitoring device 17 is indicative of the ratio of tobaccos which form the blend, i.e., the ratio of various tobaccos in the stream S at the underside of the lower reach of the conveyor 2. Thus, the intensity and/or at least one other characteristic of the signal at the output of the position monitoring device 17 changes if the ratio of at least one of the three main constituents (Virginia, Burley and Oriental) of the stream S is changed while the cigarette rod making machine is in use. Therefore, the person in charge of operating the rod making machine can ascertain, by looking at the signal displaying means 20, whether or not the blend which forms the stream S is proper. If the signal indicates that the blend is unsatisfactory, the operator can adjust the tobacco processing equipment in order to ensure that the distributor including the duct 1 delivers a satisfactory mixture of two or more tobaccos. It can be said that the position monitoring device 17 and the signal displaying means 20 together constitute a unit which measures the ratio of tobaccos in the blend constituting the stream S, i.e., the nature of the mixture of two or more different tobaccos which are contained in the filler of the cigarette rod.

Figure 2:
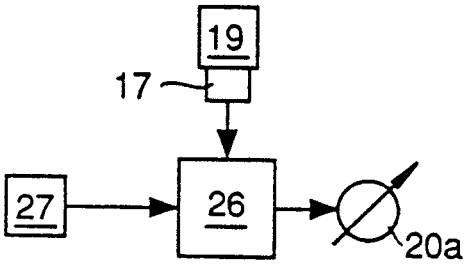
FIG. 2 is a schematic view of a portion of a modified apparatus.

FIG. 2 shows a portion of a modified apparatus which is designed to ascertain the dynamic events during adjustment of the trimming or equalizing device 10 by the motor 19. The apparatus comprises a summing or totalizing circuit 26 which receives signals from the output of the position monitoring device 17, and this apparatus further comprises a preferably adjustable timer 27. The summing circuit 26 totalizes the positive and negative signals from the position monitoring device 17 irrespective of the sign of the signals and transmits to the signal displaying device 20*a* signals denoting all changes of positions of the plane E relative to the lower reach of the conveyor 2 within an interval of time which is selected by the setting of the timer 27. This enables the person in charge of operating the rod making machine to ascertain whether or not the stream S on the conveyor 2 contains a blend of two or more different tobaccos the mixture of which has undergone a relatively large number of short-lasting changes. Thus, such operator can draw conclusions concerning the quality of the tobacco processing operation which involves the preparation of mixture that is supplied via duct 1. Signals which are supplied to the signal displaying device 20*a* of FIG. 2 can also be used to correct the quality of mixture if the detected blend of tobaccos on the conveyor 2 is unsatisfactory.

It is equally within the purview of the invention to employ an apparatus which embodies the features of the apparatus of FIGS. 1 and 2. The displaying device 20 then serves to indicate slower long-range variations of the blend, and the displaying device 20*a* serves to indicate more rapid short-range variations of the blend. The exact details of the timer 27 and summing circuit 26 (both commercially available components) form no part of the invention.

The apparatus which embodies the structure of FIG. 2 can be utilized with particular advantage when the position of the trimming plane E relative to the conveyor 2 varies at a relatively high frequency. As mentioned above, this can be indicative of continuous fluctuations of the ratio of two or more tobaccos in the stream S. The sum of distances which the plane E covers relative to the conveyor 2 within an interval of time which is selected by the timer 27 is indicative of fluctuations of the ratio of tobaccos in the stream.

Figure 3:
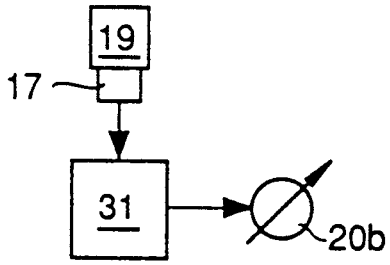
FIG. 3 is a schematic view of a portion of a third apparatus.

FIG. 3 shows a portion of an apparatus which constitutes a modification of the apparatus of FIG. 2. An advantage of the apparatus of FIG. 3 is that it renders it possible to permit more rapid detection or determination and evaluation of dynamic events due to a standardized processing of signals from the position monitoring device 17. The apparatus of FIG. 3 comprises a computing stage 31 which is connected between the device 17 and a signal displaying device 20*b*. The purpose of the computing stage 31 is to transmit signals denoting the value of sigma, namely fluctuations of measured distances of the plane E from the lower reach of the conveyor 2 relative to an average value. Sigma denotes a standard deviation above and below the average value and can be expressed in the form of equation $$\sigma = \sqrt{\frac{\sum_{i=1}^{n} (x - xi)^2}{n - 1}}$$

wherein xi denotes momentary values, $\bar{x}$ denotes the average value and n denotes the number of ascertained momentary values of the distance 18 of the plane E from the lower reach of the conveyor 2. Signal computing stages of the type capable of ascertaining the value of sigma are well known and are available on the market.

The value of sigma is indicative of the constancy of mixture of tobaccos in the stream S within a given interval of time.

Figure 4:
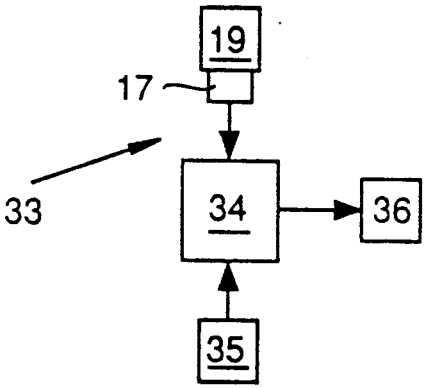
FIG. 4 is a schematic view of a portion of an apparatus which can be utilized to regulate the hardness of the tobacco stream.

It has been ascertained that the apparatus which is shown in FIG. 1 can also be used with advantage to ascertain the filling power of tobacco in the stream S or that it can be used to ascertain only the filling power of tobacco on the conveyor 2. The reason is that, quite surprisingly, the signal at the output of the position monitoring device 17 is indicative of filling power (hardness) of tobacco in the stream S. It is equally possible to resort to the modifications which are shown in FIGS. 2 and 3, i.e., to a signal comparing stage 26 and/or to a computing stage 31. In addition, and as shown in FIG. 4, the signal at the output of the position monitoring device 17 can be smoothed and transmitted to a regulating circuit 33 wherein a signal comparing stage 34 compares the actual value signal from the monitoring device 17 with a reference signal from a potentiometer 35 or another preferably adjustable source of reference signals. The signal at the output of the comparing stage 34 is indicative of deviations of actual hardness from optimum hardness and is amplified by an amplifier 36 which transmits signals serving to regulate the operation of the motor 19 in a sense to maintain the hardness of the cigarette rod and of discrete rod-shaped smokers' products at an at least substantially constant value. This is possible because the filling power of tobacco and the hardness of cigarettes which are obtained from such tobacco are in a predetermined relationship to each other. The regulating circuit 33 can be designed in such a way that the density regulating means 21, 22, 23 of FIG. 1 become operative only when the density of finished products drops below a predetermined minimum acceptable value or rises above a maximum acceptable value; this prevents the making of very lightweight or very heavy cigarettes for relatively long intervals of time. In other words, the adjustment of trimming plane E by way of the signal comparing stage 22 and motor 19 can be dispensed with as long as the filling power is regulated with the apparatus including the structure of FIG. 4, provided that the density of the cigarette rod and of rod-shaped smokers' products does not drop below the aforementioned minimum acceptable value or does not rise above the aforementioned maximum acceptable value. The just described apparatus and method can be resorted to in order to save tobacco if the filling power of tobacco is very pronounced.

Figure 5:
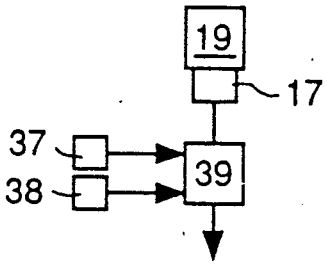
FIG. 5 is a schematic view of a portion of a further apparatus wherein the signals denoting the ratio of various tobaccos in the stream can be corrected to account for the influence of variations of temperature and moisture content of the tobacco stream.

The temperature and the moisture content of tobacco in the stream can adversely affect the accuracy of signals which are transmitted by the position indicating device 17. Therefore, the apparatus can further comprise a moisture detector 37 (FIG. 5) which ascertains fluctuations of moisture content in the stream S and a temperature monitoring device 38 (FIG. 5) which ascertains fluctuations of temperature of the stream. Signals from the detector 37 and monitoring device 38 are transmitted to a signal correcting circuit 39 which corrects the signals from the position monitoring device 17 accordingly so that the signals which are displayed at 20 are less influenced, or are not influenced at all, by fluctuations of the temperature and/or moisture content. Thermometers and moisture detectors of the type capable of monitoring the corresponding parameters of a tobacco stream are well known in the tobacco processing industry.

An important advantage of the improved method and apparatus is that the ratio of different tobaccos in the stream S can be monitored and corrected, when necessary, in a simple and inexpensive way by monitoring the distance of the trimming or equalizing plane E from the lower reach of the conveyor 2. Thus, the distance of the plane E from the conveyor 2 is indicative of the ratio of different tobaccos in the stream and hence of the quality of the blend.

It is desirable to ensure that the blend will remain constant because the blend determines an important quality of smokers' products, namely the taste. Manufacturers of cigarettes attribute much importance to the production of cigarettes wherein the taste of each brand is constant because this determines the popularity of the respective brand. Deviations of the blend from a desired value or ratio of respective tobaccos is normally indicative of disturbances and/or irregularities in the tobacco processing operation. Such deviations could remain undetected for long intervals of time, i.e., a cigarette rod maker would be likely to turn out long series of unsatisfactory smokers' products.

Another important advantage of the improved method and apparatus is that monitoring of the distance of the trimming plane E for surplus tobacco T from the conveyor 2 not only furnishes information concerning the ratio of various tobaccos in the stream but can also serve to furnish indications concerning the filling power of processed tobacco. Such determination of filling power is not only simple and inexpensive but can be achieved while the apparatus monitors the ratio of tobaccos in the stream S, i.e., the distance of the plane E from the conveyor 2. Each of these two methods and the corresponding apparatus is believed to constitute an invention of high order. All that is necessary in order to properly ascertain the filling power of tobacco is to regulate the operation of the trimming device 10 in such a way (and this is the customary and preferred way) that the density (also called mass flow) of the tobacco stream is maintained at a constant value. It is already known to monitor the filling power of tobacco in a moving stream; however, conventional monitoring methods and apparatus are much more complex than the novel method and apparatus, i.e., the step of and the means for monitoring the distance of the trimming plane E from the conveyor 2.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A method of monitoring the quality of a stream which is a blend of several tobaccos, which is transported by a conveyor and which contains a surplus of tobacco, comprising the steps maintaining the mass flow of tobacco on the conveyor at an at least substantially constant value; removing the surplus from the stream on the conveyor; and monitoring the ratio of several tobaccos in the blend.

2. The method of claim 1, wherein said removing step includes equalizing the stream in a plane which is located at a variable distance from the conveyor, depending on the quantity of surplus in the stream on the conveyor, said monitoring step including monitoring the distance of said plane from the conveyor and said distance being indicative of the ratio of tobaccos in the blend.

3. The method of claim 2, further comprising the step of ascertaining changes of distance of said plane from the conveyor within a predetermined period of time.

4. The method of claim 2, further comprising the step of ascertaining the extent of standard deviations of said distance from an average value.

5. The method of claim 2, further comprising the steps of generating signals denoting said distance and displaying said signals.

6. The method of claim 1, further comprising the steps of generating first signals denoting the monitored ratio of several tobaccos in the blend, monitoring the temperature of tobacco in the stream, generating second signals denoting the monitored temperature, and correcting said first signals in dependency upon the characteristics of said second signals to eliminate the influence of temperature of the stream upon the accuracy with which the first signals denote the ratio of tobaccos in the blend.

7. The method of claim 1, further comprising the steps of generating first signals denoting the monitored ratio of several tobaccos in the blend, monitoring the moisture content of tobacco in the stream, generating second signals denoting the monitored moisture content, and correcting said first signals in dependency on the characteristics of said second signals to eliminate the influence of moisture of the stream upon the accuracy with which the first signals denote the ratio of tobaccos in the blend.

8. A method of monitoring the quality of a stream which is a blend of several tobaccos, which is transported by a conveyor and which contains a surplus of tobacco, comprising the steps removing the surplus from the stream on the conveyor including equalizing the stream in a plane which is located at a variable distance from the conveyor, depending upon the quantity of surplus in the stream on the conveyor; and monitoring the filling power of tobacco in the stream, including monitoring the distance of said plane from the conveyor.

9. The method of claim 8, further comprising the step of maintaining the mass flow of tobacco in the stream at an at least substantially constant value.

10. The method of claim 8, further comprising the step of ascertaining changes of distance of said plane from the conveyor within a predetermined period of time.

11. The method of claim 11, further comprising the step of ascertaining the extent of standard deviations of said distance from an average value.

12. The method of claim 8, further comprising the steps of generating first signals denoting the monitored filling power, monitoring the temperature of tobacco in the stream, generating second signals denoting the monitored temperature, and correcting the first signals in dependency upon the characteristics of said second signals to eliminate the influence of temperature of the stream upon the accuracy with which the first signals denote the filling power of tobacco in the stream.

13. The method of claim 8 further comprising the steps of generating first signals denoting the monitored filling power, monitoring the moisture content of tobacco in the stream, generating second signals denoting the monitored moisture content, and correcting the first signals in dependency upon the characteristics of second signals to eliminate the influence of moisture content upon the accuracy with which the first signals denote the filling power of tobacco in the stream.

14. The method of claim 8, further comprising the steps of generating signals denoting said distance and displaying said signals.

15. The method of claim 8, further comprising the steps of generating signals denoting the filling power of tobacco in the stream, and regulating the filling power of tobacco as a function of said signals.

16. Apparatus for monitoring the quality of a stream which is a blend of several tobaccos and contains a surplus of tobacco, comprising means for transporting the stream along a predetermined path; means for removing the surplus from the stream in a predetermined portion of said path; and means for monitoring the ratio of tobaccos in the blend.

17. The apparatus of claim 16, further comprising means for maintaining the mass flow of tobacco on the conveyor at an at least substantially constant value.

18. The apparatus of claim 16, wherein said removing means includes means for equalizing the stream in a predetermined plane and for varying the distance of said plane from said transporting means in dependency upon the quantity of surplus in said portion of said path, said means for monitoring including means for measuring the distance of said plane from said transporting means.

19. The apparatus of claim, 16, wherein said removing means includes means for equalizing the stream in a predetermined plane and for varying the distance of said plane from said transporting means in dependency upon the quantity of surplus in said portion of said path, said means for monitoring including means for measuring the extent of travel of said plane relative to said transporting means.

20. The apparatus of claim 16, wherein said removing means includes means for equalizing the stream in a predetermined plane and for varying the distance of said plane from said transporting means in dependency upon the quantity of surplus in said portion of said path, said means for monitoring including means for measuring the distance of said plane from said transporting means and further comprising means for ascertaining the extent of standard deviations of said distance from an average value.

21. The apparatus of claim 16, wherein said means for monitoring includes means for generating signals denoting the monitored distance, and further comprising means for displaying said signals.

22. Apparatus for monitoring the quality of a stream which is a blend of several tobaccos and contains a surplus of tobacco, comprising means for transporting the stream along a predetermined path; means for removing the surplus from the stream in a predetermined portion of said path, said removing means including means for equalizing the stream in a predetermined plane and for varying the distance of said plane from said transporting means in dependency upon the quantity of surplus in said portion of said path; and means for monitoring the filling power of tobacco in the stream, including means for ascertaining the distance of said plane from said transporting means.

23. The apparatus of claim 22, further comprising means for maintaining the mass flow of tobacco on said transporting means at an at least substantially constant value.

24. The apparatus of claim 22, wherein said ascertaining means includes means for measuring the extent of travel of said plane relative to said transporting means.

25. The apparatus of claim 22, further comprising means for ascertaining the extent of standard deviations of said distance from an average value.

26. The apparatus of claim 22, wherein said monitoring means includes means for generating signals denoting the distance of said plane from said transporting means and further comprising means for displaying said signals.

27. The apparatus of claim 22, wherein said monitoring means comprises means for generating signals denoting the filling power of tobacco in the stream, and further comprising means for regulating the filling power of tobacco as a function of said signals.

* * * * *